United States Patent [19]

Albrecht

[11] 4,117,456

[45] Sep. 26, 1978

[54] TRAFFIC SIGNAL HOUSING

[75] Inventor: Leonard N. Albrecht, Beverly Hills, Calif.

[73] Assignee: Econolite Control Products Inc., Anaheim, Calif.

[21] Appl. No.: 814,201

[22] Filed: Jul. 11, 1977

[51] Int. Cl.[2] ..... E01F 9/00

[52] U.S. Cl. ..... 340/119; 340/84; 40/564; 362/196; 362/226; 362/362; 362/374

[58] Field of Search ..... 340/119, 84, 87, 41, 340/41 A, 42, 321, 74; 40/132 R, 133 R; 200/307, 308, 309; 339/44, 206, 207, 208; 325/355, 356; 116/63 R, 63 P; 249/144, 11, 12, 2, 39; 362/84, 154, 162, 167, 174, 186, 189, 196, 226, 362, 374, 457

[56] References Cited

U.S. PATENT DOCUMENTS

| | | | |
|---|---|---|---|
| 2,534,992 | 12/1950 | Reid | 362/374 |
| 3,706,070 | 12/1972 | Eikenberry | 340/119 |
| 3,991,400 | 11/1976 | Beuhler | 340/119 |
| 3,999,160 | 12/1976 | McDonnell | 340/119 |

*Primary Examiner*—John W. Caldwell, Sr.

*Assistant Examiner*—Donnie L. Crosland

*Attorney, Agent, or Firm*—Edward A. Sokolski

[57] ABSTRACT

A housing for traffic signal lamps employs modular building block units with a minimum number of different components, which can be combined together to form a variety of configurations. A basic half section unit is used to form the individual lamp housings. This half section unit is in the form of a tray having an internal rib structure and an external rib on the front surface for stiffening, a pair of such units being joined together to form a container for a traffic lamp. An aperture is formed in the front wall of the container for passing the light from the lamp, there being a door wth a mating aperture formed therein removably latched to a hinge pin structure formed on the front wall of the container. This hinge pin structure and the latching mechanism on the door are arranged to permit either right or left hand opening of the door. A plurality of the signal lamp units can be stacked as desired to form a composite signal lamp display with the individual units being joined together to form an assembly along with a back plate which fits into retaining channels formed along the side edges of the individual container units.

7 Claims, 10 Drawing Figures

TRAFFIC SIGNAL HOUSING

This invention relates to traffic signal lamp housings, and more particularly to such a housing having a modular construction employing a few basic building block units in its implementation which is particularly suited to fabrication from plastic.

In order to cut down the cost and the weight of traffic signal housings, fabricators have in recent years turned to the use of plastic. Such prior art plastic signal housings, like their predecessors in metal, generally employ one piece construction. The cost of molding such one-piece housings along with the various parts included therein has been found to be somewhat expensive and difficult to mold. In using plastic it is necessary to provide ribs for stiffening to insure the structural integrity of the housing. In designs of the prior art, attempts at stiffening involve the utilization of deep ribs which are difficult to mold. In addition, such one-piece housing of the prior art employ a type of external ribbing which is both unsightly and a dirt collector. It has further been found that even with all of the ribbing employed in the devices of the prior art, the housing still tends to have flexure along the front portions thereof, making it difficult to seal the front door.

The device of the present invention overcomes the aforementioned shortcomings of the prior art by employing a modular construction utilizing relatively small basic building block units which can be combined together to form a composite housing in a variety of configurations. The basic units of the present invention are particularly suited to plastic molding. Further, these units employ a type of internal ribbing which affords excellent stiffening but which is relatively easy to mold and can be fabricated with relatively low cost tooling. External ribbing is provided only along the front face of the units for extra stiffening to facilitate sealing of the door, the remaining of the external walls of the housing being free of stiffening ribs. In view of its modular building block structure, the device of the present invention can readily be adapted to a variety of signal lamp configurations, thus minimizing the number of basic housing structures which need be stocked by the user. Further, the access doors for the individual lamp units are adapted to be mounted for either left or right hand opening and have hinge structures which enable the entire removal of the door if such be necessary for repair or replacement.

It is therefore an object of this invention to provide a traffic signal housing of simpler and more economical construction than prior art devices.

It is a further object of this invention to provide a traffic signal housing of modular construction which is particularly suited to plastic fabrication.

It is a further object of this invention to provide a plastic traffic signal housing which is of more rigid construction than prior art plastic housings.

Other objects of this invention will become apparent from the following description taken in connection with the accompanying drawings, of which:

Briefly described, the device of my invention is as follows:

A container for a traffic signal lamp is formed from a pair of similar units which are joined together along their edges. Each of these units is in the form of a tray which has a plurality of internal stiffening ribs and an external stiffening rib on the front wall, which wall is apertured. A door having an aperture formed therein, which mates with the aperture in the front wall, for passing the light from the signal lamp is mounted on the front wall of the signal lamp container by means of a hinge pin structure, the front door having a latching mechanism adapted for use with this hinge pin structure. Dual latching mechanisms are provided on one side of the door so that the door can be hinged for either left or right side opening. A plurality of individual signal lamp containers can be stacked to form a composite housing, the lamp containers being held together by means of suitable hardware along with back plates which fit into retaining channels formed along the sides of the container units, the uppermost and lowermost container units being attached to support stanchions or the like.

Figure 1:
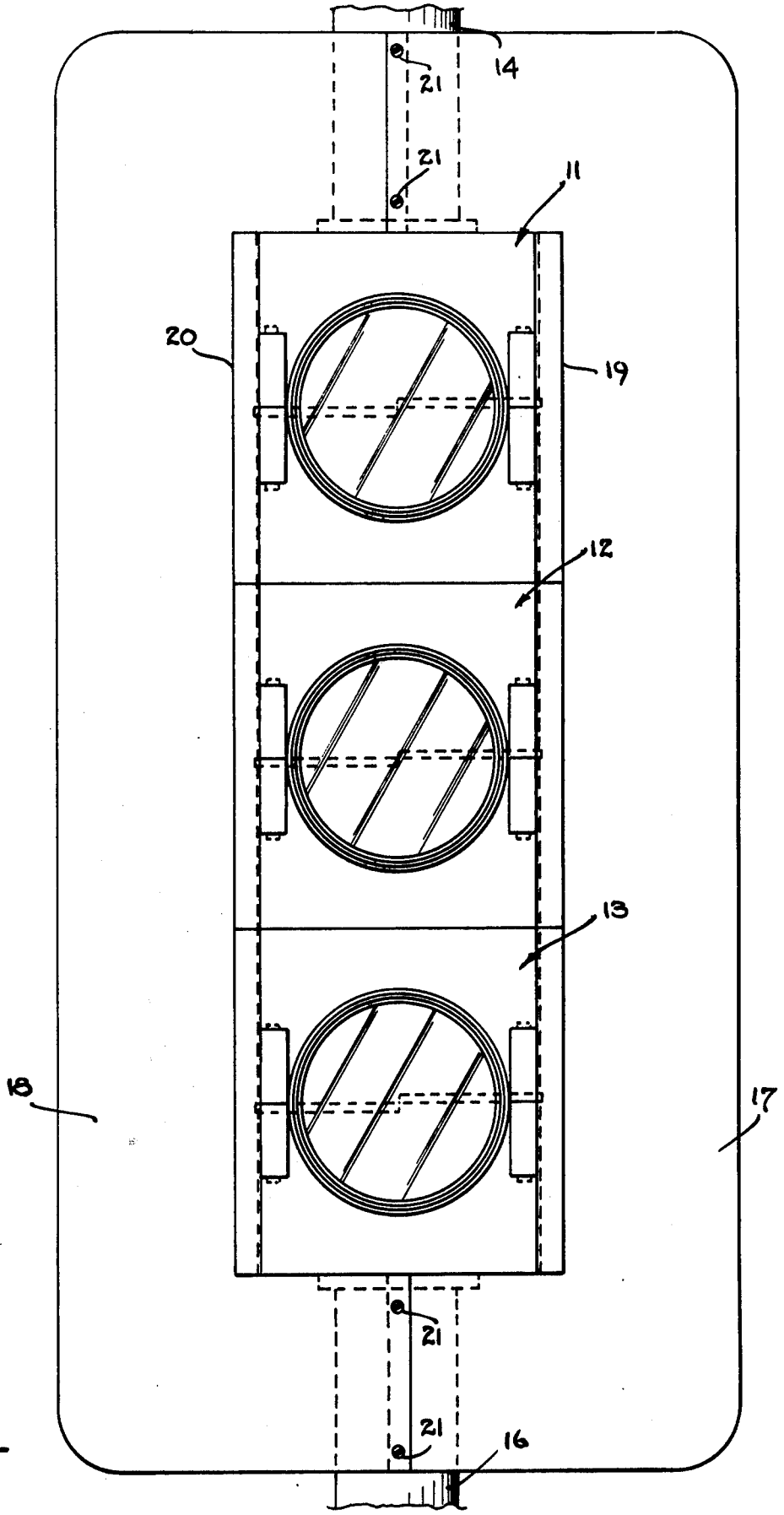
FIG. 1 is a front elevational view illustrating a composite traffic signal array of the present invention.

Referring now to FIG. 1 the device of the invention is shown as employed to form a typical three-lamp signal light configuration. The assembly is formed from a plurality of similar signal lamp container units 11–13 which are stacked on each other. Unit 11 is attached to support stanchion 14 by means of coupling hardware (not shown) which fits through an aperture in the top wall of this unit, while unit 13 is similarly supported on stanchion 16. The three units 11–13 are held together by means of bolts and nuts or Sure-lock fasteners (not shown). Back plates 17 and 18 fit in channels 19 and 20 formed along the side edges of the container units and are joined together at the top and bottom by means of bolts 21.

Figure 2:
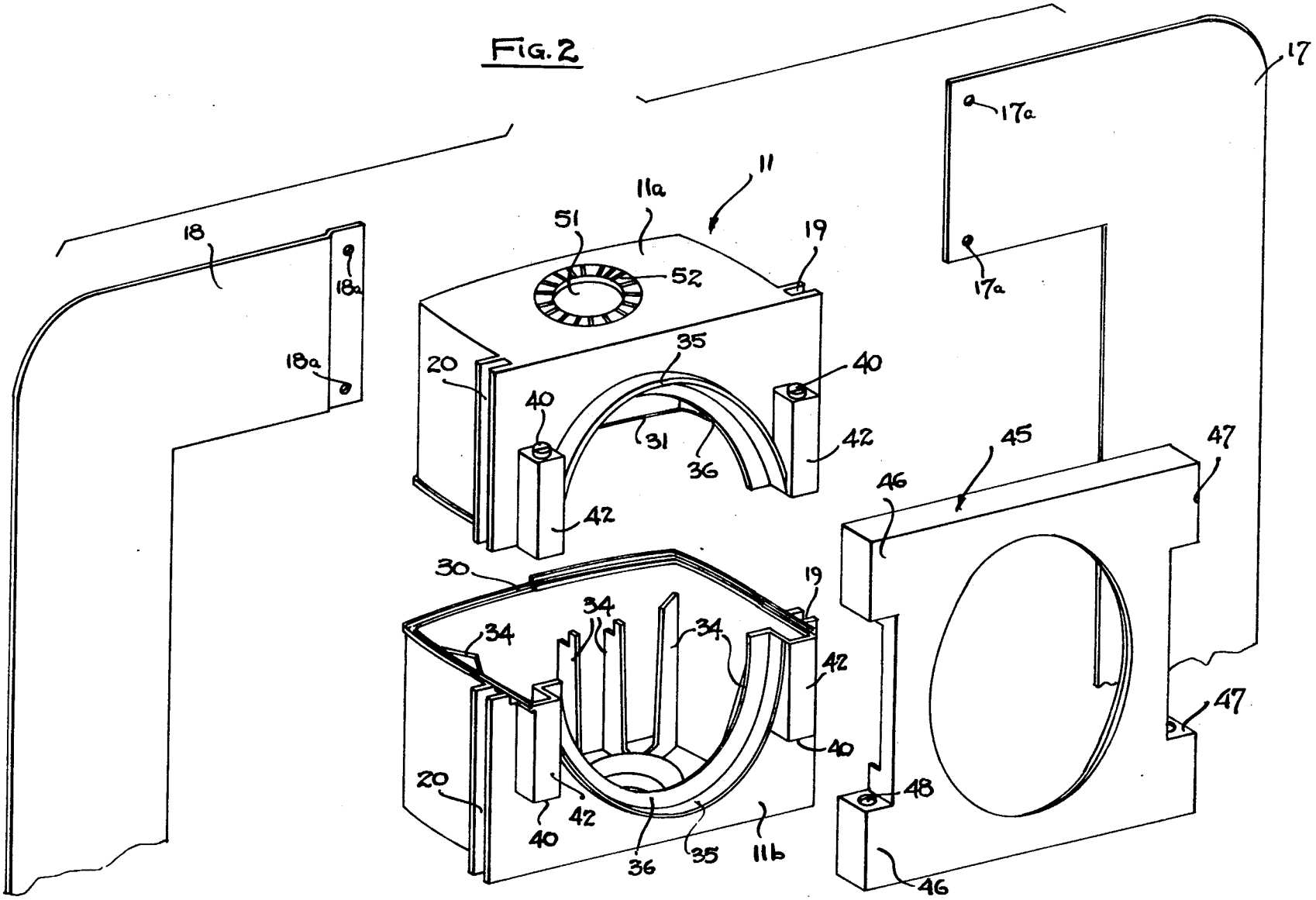
FIG. 2 is an exploded view illustrating the assembly of a composite traffic signal housing of the present invention.

Referring now to FIG. 2, the topmost container 11 is illustrated in an exploded view in combination with side plates 17 and 18. As can be seen, container 11 is formed from similar half-sections **11*a* and 11*b*. These half-sections are cemented together along their edges to form an integral unit, stepped portions 30 and 31 being formed along the opposing edges to facilitate their joinder. Stiffening ribs 34 which run radially inwardly from the side walls of the half-sections are provided to stiffen the structure. Further, external semicircular ribs 35 are provided on the outer front wall also for stiffening purposes. Semicircular cutouts 36 are provided in each of the half-sections to form an aperture for the light from the signal lamp. Half-sections 11*a* and 11*b*** are in the form of trays, which when joined together form a container or box for the signal lamp.

Channels 19 and 20 are formed along the edges of the container by means of oppositely positioned strip sections, these channels being adapted to receive the side edges of back plates 17 and 18. Back plates 17 and 18 are installed in the channels and bolts fitted through apertures 17*a* and 18*a* of the plates to hold the plates to the containers.

Figure 7:
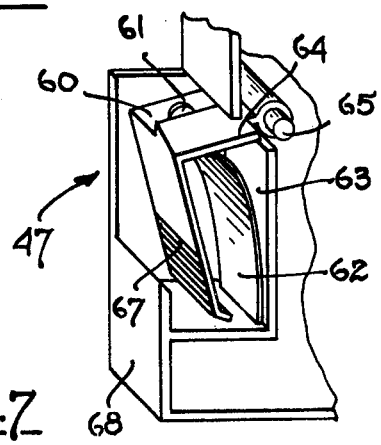
FIG. 7 is a perspective view illustrating the latching mechanism of the door unit of FIG. 5.

Hinge pins 40 extend from the ends of posts 42 formed on the front walls of the container half-sections. Hinge pins 40 are beveled towards the front of posts 42 and are adapted to mount door 45 thereon. Door 45 has a pair of hinge units 46 formed along one edge thereof, these hinge units having apertures 48 formed therein, in which hinge pins 40 are received. Latches 47, the structure of which is shown in FIG. 7 and which are described more fully further on in the specification, are used to latch and unlatch the door. It is to be noted that door 45 is symmetrically constructed so that it may be attached to the container for either left or right hand door opening.

Figure 3:
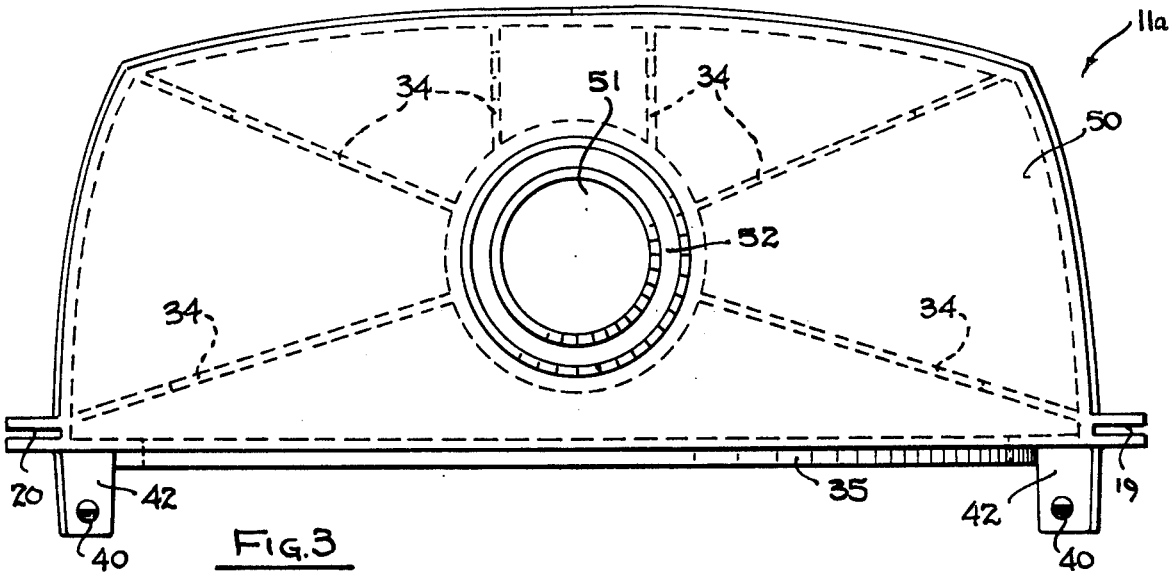
FIG. 3 is a top plan view of a preferred embodiment of a basic container section of the present invention.
Figure 4:
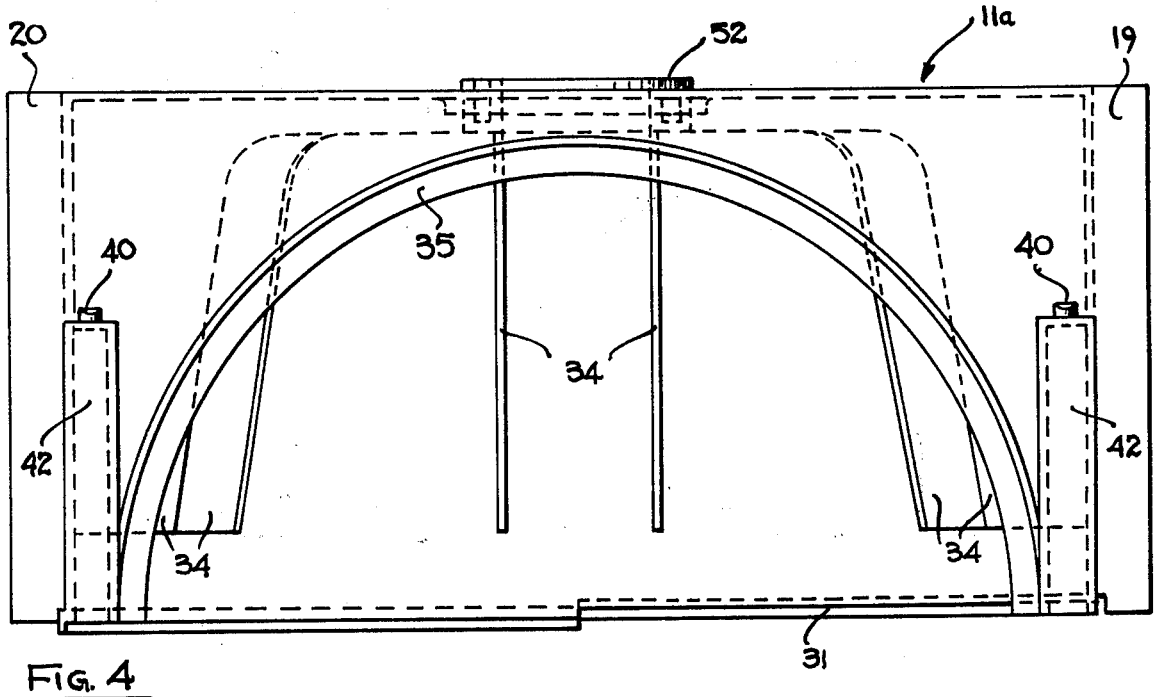
FIG. 4 is a front elevational view of the preferred embodiment of the basic container section.

Referring now to FIGS. 3 and 4, the structure of the container unit half-sections is shown in greater detail. As can be seen, the top wall 50 of the unit has an aperture 51 formed therein for receiving a support stanchion, there being a grooved ring 52 formed around this aperture to facilitate the attachment of such stanchion with a hollow bolt and/or snap device or the like. As already noted, ribs 34 and 35 are provided to stiffen the structure. Posts 42 are located on opposite sides of the half section and have hinge pins 40 formed in their top surfaces. Apertures 51 may also be used to receive hardware such as Sure-lock fasteners for joining the stacked container units together.

Referring now to FIGS. 5–9, the details of the door structure of the preferred embodiment are illustrated. Hinge members 46 are formed along one edge of door 45 and have apertures 48 formed therein which matingly engage hinge pins 40 on the lamp container. These hinges thus can be snapped in position over the pin as indicated in FIG. 2. Along an opposite edge of the door are a pair of latch members 47. The structure and operation of these latch members can best be seen by reference to FIG. 7. Latch 47 has a stepped portion 60 forming a latch plate in which aperture 61 is formed. With the latch in its latched condition, associated ones of the container hinge pins 40 are matingly received in latch member apertures 61. The latch member is retained in its latched condition by virtue of the action of spring 62, one end of which abuts against tab member 63 which extends from the side wall of the door, and the other end of which abuts against lever arm 64 which is pivotally mounted on pin 65. Extending substantially normally from lever arm 64 is latch actuator plate 67.

With latch member 47 in the latched condition, actuator plate 67 is flush with the side wall 68 of the door, with hinge pin 40 seated in aperture 61. When actuator plate 67 is depressed inwardly as shown in FIG. 7, latch plate 60 is rotated about pivot pin 65 withdrawing this latch plate from engagement with hinge pin 40. It can be seen that the door has a symmetrical structure such that it can be hinged on one side or the other of the container unit, thus enabling either left or right hand door opening. Further, it is to be noted that the door can readily be completely removed from the container unit in the field, either for replacement or so as to change the door opening from one side to the other.

Figure 8:
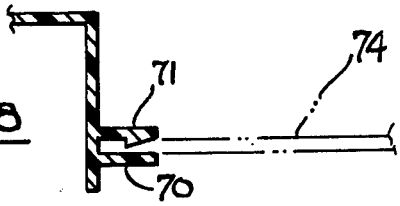
FIG. 8 is a cross sectional view taken along the plane indicated by 8—8 in FIG. 5.
Figure 9:
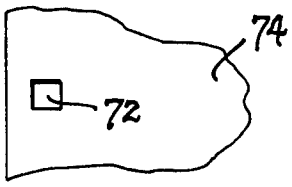
FIG. 9 illustrates a latching edge portion of a hood which may be used with the device of the invention.
Figure 6:
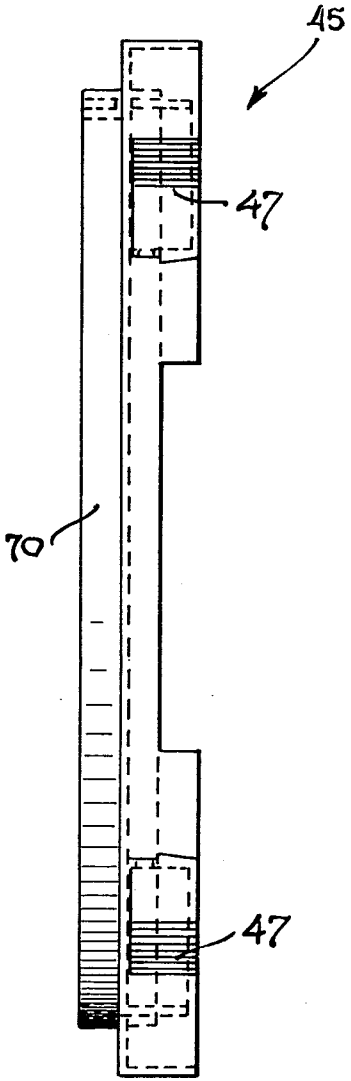
FIG. 6 is a side elevational view of the door unit of FIG. 5.
Figure 5:
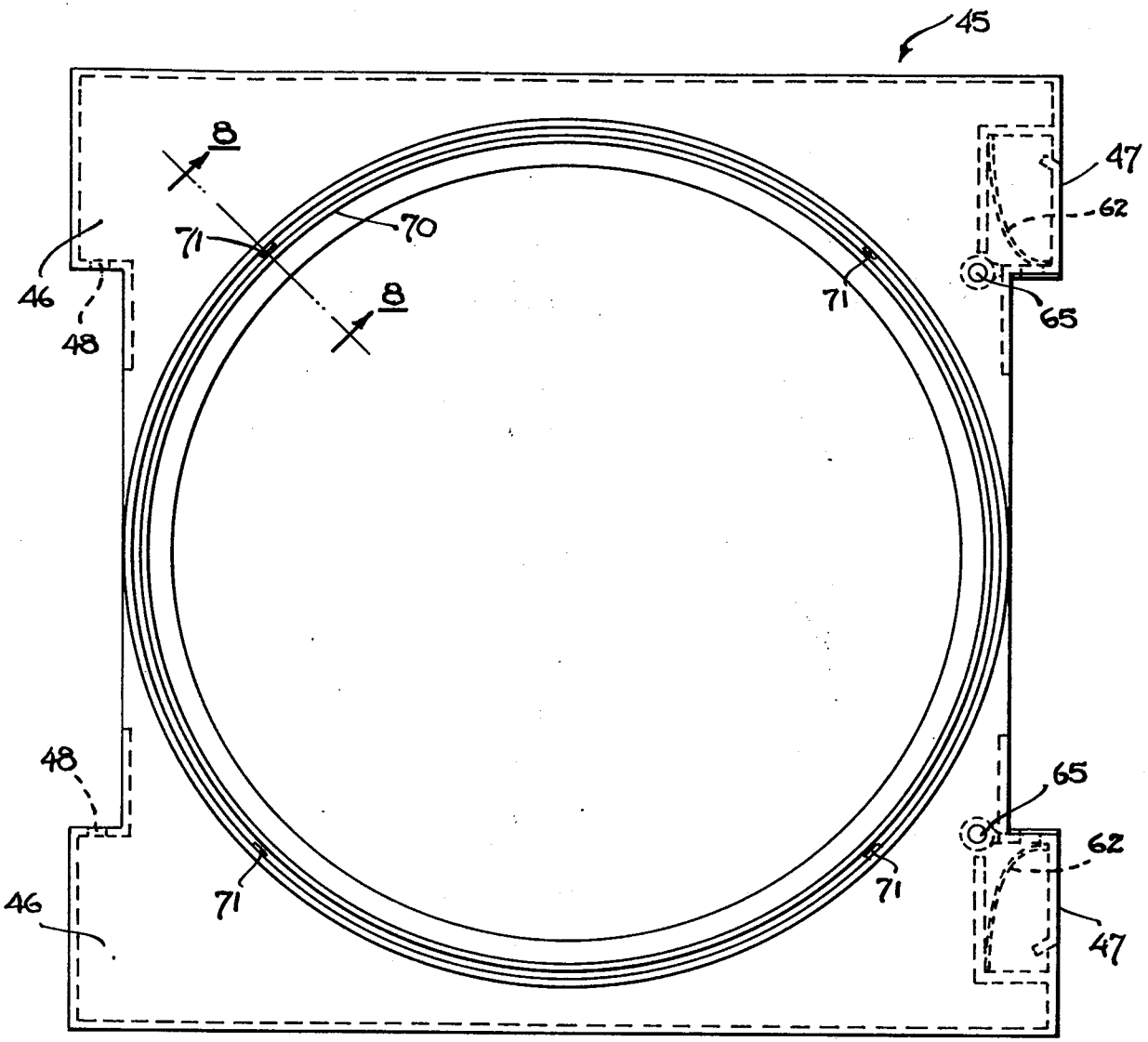
FIG. 5 is a front elevational view showing a preferred embodiment of a front door unit of a container unit of the invention.

Referring now particularly to FIGS. 5, 8 and 9, an attachment mechanism for attaching a hood or the like to the door is illustrated. The door has a bezel 70 which runs around the edge thereof, this bezel having a plurality of clamping fingers 71 formed thereon for receiving a hood member. As can be seen in FIG. 8, clamping finger members 71 have a bayonet type latching structure which operates in conjunction with bezel 70 to engage an aperture 72 (see FIG. 9) formed along the edges of the hood 74.

Figure 10:
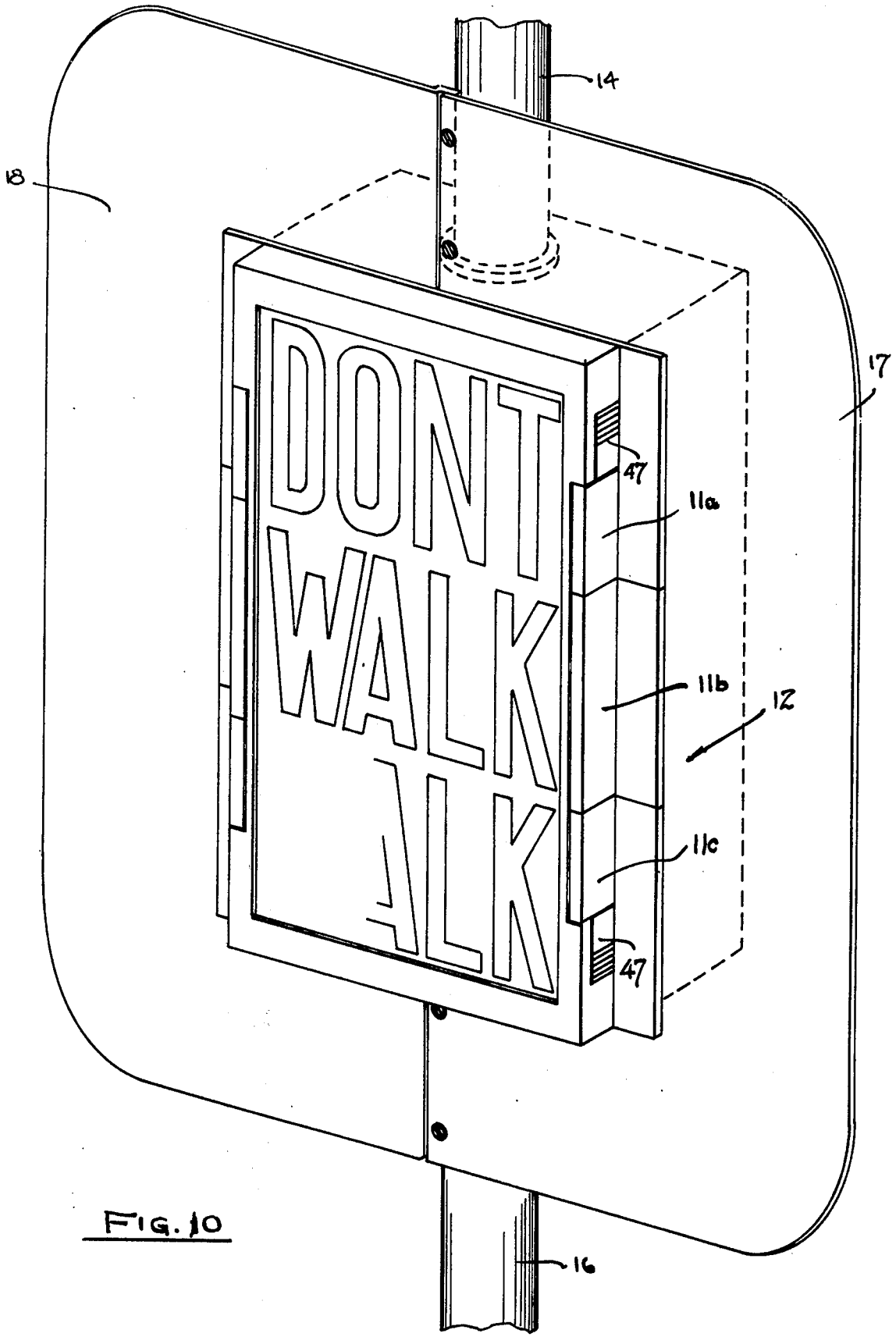
FIG. 10 is a perspective view illustrating an adaptation of the device of the invention for use as a pedestrian signal.

The device of the invention can obviously be adapted to operate with signal displays other than that illustrated in FIG. 1. Thus it could be used for a pedestrial signal lamp, as illustrated in FIG. 10, or other types of rectangular type message displays. As shown in FIG. 10, the device of the invention employs three sectional units, 11*a*, 11*b* and 11*c*, joined together to form a rectangular pedestrial signal display. This unit is basically the same as that just described. It differs only in the fact that a rectangular rather than a round opening is provided in the front in both the container and the door structures.

While the device of the invention has been described and illustrated in detail, it is to be clearly understood that this is intended by way of illustration and example only and is not to be taken by way of limitation, the spirit and scope of this invention being limited only by the terms of the following claims.

I claim:

1. A traffic signal housing comprising a pair of similar tray shaped half-section units having front, rear and side walls and joined together along the edges of said walls to form a lamp container, each of said sections including a plurality of stiffening ribs contained therein, said ribs running radially inwardly from the side walls of said sections, an aperture formed in the front walls of said sections, a stiffening rib on the external surface of said front wall running along said aperture, similar posts symmetrically arranged on opposite sides of said front wall, each of said posts having a hinge pin thereon, and a door with an aperture formed therein, said door having a pair of similar hinge members arranged in spaced relationship with each other along one side of said door and a pair of latch members arranged in spaced relationship with each other along the side of said door opposite said one side thereof, said latch members being spaced from each other the same distance as said hinge members, said hinge members and latch members having apertures formed therein which matingly engage the hinge pins of said containers, whereby said door is adapted to be removably hinged on said container for either left or right hand opening.

2. The traffic signal housing of claim 1 wherein the apertures in said container and said door are circular, said ribs on the front walls of said sections forming a continuous circular rib surrounding the aperture in said container.

3. The traffic signal housing of claim 1 including a plurality of similar said containers stacked on top of each other, said containers having channels formed along the side walls thereof and a pair of back plates having top, bottom and side sections, said side sections being fitted in said channels and said top and bottom sections being joined together over the top of the uppermost of said containers and under the lowermost of said containers.

4. The signal housing of claim 1 wherein the mating edges of the rear walls of said half sections are stepped to facilitate the mating thereof.

5. The signal housing of claim 1 wherein the door has a bezel formed around the aperture thereof, said bezel having a plurality of baynet latching members formed therein adapted to receive a hood member.

6. The signal housing of claim 1 wherein the latch members each comprises a latch plate having an aperture formed therein for receiving a container hinge pin, means for pivotally supporting said latch plate, an actuator plate extending substantially normally from said latch plate, and spring means for urging said latch plate to a position whereat the actuator plate is flush with a surface of said door whereby when said actuator plate is depressed the latch plate is drawn out of engagement with the associated hinge pin.

7. The traffic signal housing of claim 1 wherein the apertures in said container and said door are rectangular.

* * * * *